US009809036B2

(12) United States Patent
Chandu et al.

(10) Patent No.: US 9,809,036 B2
(45) Date of Patent: Nov. 7, 2017

(54) DYNAMIC INKJET NOZZLE FLUSHING MECHANISM

(75) Inventors: Kartheek Chandu, Longmont, CO (US); Carl Bildstein, Lafayette, CO (US)

(73) Assignee: Ricoh Company, Ltd., Tokyo (JP)

( * ) Notice: Subject to any disclaimer, the term of this patent is extended or adjusted under 35 U.S.C. 154(b) by 809 days.

(21) Appl. No.: 13/242,507

(22) Filed: Sep. 23, 2011

(65) Prior Publication Data

US 2013/0076820 A1 Mar. 28, 2013

(51) Int. Cl.
*B41J 2/165* (2006.01)
*B41J 2/21* (2006.01)

(52) U.S. Cl.
CPC ..... *B41J 2/2142* (2013.01); *B41J 2/16526* (2013.01)

(58) Field of Classification Search
None
See application file for complete search history.

(56) References Cited

U.S. PATENT DOCUMENTS

| | | | | |
|---|---|---|---|---|
| 5,530,462 | A | 6/1996 | Takahashi | |
| 7,150,513 | B2 | 12/2006 | Shinkawa | |
| 7,455,386 | B2 * | 11/2008 | Ito | 347/35 |
| 7,537,308 | B2 | 5/2009 | Yamane | |
| 7,798,588 | B2 | 9/2010 | Arazaki | |
| 8,091,974 | B2 * | 1/2012 | Ino et al. | 347/9 |
| 2009/0225128 | A1 | 9/2009 | Kuroda | |
| 2010/0053241 | A1 * | 3/2010 | Chandu et al. | 347/9 |
| 2010/0177136 | A1 | 7/2010 | Koase | |
| 2011/0234676 | A1 * | 9/2011 | Nishikawa | 347/19 |

FOREIGN PATENT DOCUMENTS

| | | | |
|---|---|---|---|
| JP | 11/192723 | | 12/1997 |
| JP | 2004/025627 | | 6/2002 |
| JP | 2003/159785 | | 3/2003 |
| JP | 2005/161615 | | 12/2003 |
| JP | 2006/168074 | | 12/2004 |
| JP | 2009/090533 | | 10/2007 |
| JP | 2007/185957 | | 12/2008 |
| JP | 2009214479 | A * | 9/2009 |
| JP | 2009233966 | A * | 10/2009 |

* cited by examiner

*Primary Examiner* — Bradley Thies
(74) *Attorney, Agent, or Firm* — Alpine Technology Law Group LLC

(57) ABSTRACT

A method is disclosed. The method includes analyzing an image of a first flushing pattern applied on a medium during production of a print job to detect presence of one or more defective ink jet nozzles and adjusting to a second flushing pattern during the production of the print job upon detecting the presence of one or more defective print head nozzles.

20 Claims, 5 Drawing Sheets

DYNAMIC INKJET NOZZLE FLUSHING MECHANISM

FIELD OF THE INVENTION

The invention relates to the field of printing systems. Particularly, the invention relates to flushing the nozzles in an inkjet printer.

BACKGROUND

An ink jet printer is as an example of a printing apparatus that ejects droplets of ink onto a recording medium such as a sheet of paper for printing an image of the recording medium. Ink jet printers include one or more print engines having at least one ink jet print head provided with an ink cartridge that accommodates the ink. In operation of the print engine, ink is supplied from the ink cartridge to ejection nozzles in each print head so that a printing operation is performed by ejection of the ink droplets from selected ejection nozzles.

Periodically during printing an ink jet print head is required to be flushed to ensure that the individual jet nozzles stay wet in order to prevent defective jet conditions attributed to ink drying at unused nozzles. One commonly implemented flush method is referred to as "line flushing." In line flushing all primary colors are printed on top of each other in straight line across the top or bottom of each printed page. Another flushing technique is referred to as "random flushing", in which drops are frequently ejected from each nozzle during print production.

However, nozzles may continue to become clogged using these flushing techniques because the frequency, or volume, of ink to be ejected from the nozzles may need to be increased during print production in order to prevent nozzle drying. Currently, no process is available to adjust nozzle flushing frequency during print production without stopping the printer.

Consequently, what is a needed is a mechanism to dynamically adjust nozzle flushing frequency during print production.

SUMMARY

In one embodiment, a method is disclosed. The method includes analyzing an image of a first flushing pattern applied on a medium during production of a print job to detect presence of one or more defective ink jet nozzles and adjusting to a second flushing pattern during the production of the print job upon detecting the presence of one or more defective print head nozzles.

In a further embodiment a printing system is disclosed. The printing system includes one or more print engines each having a plurality of ink jet nozzles to print a flushing pattern on a medium, a reader to capture an image of the flushing pattern and a controller. The controller analyzes the image of the first flushing pattern applied on the medium during production of a print job to detect presence of one or more defective ink jet nozzles and adjusts to a second flushing pattern during the production of the print job upon detecting the presence of one or more defective ink jet nozzles.

BRIEF DESCRIPTION OF THE DRAWINGS

A better understanding of the present invention can be obtained from the following detailed description in conjunction with the following drawings, in which.

DETAILED DESCRIPTION

A dynamic nozzle flushing mechanism is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
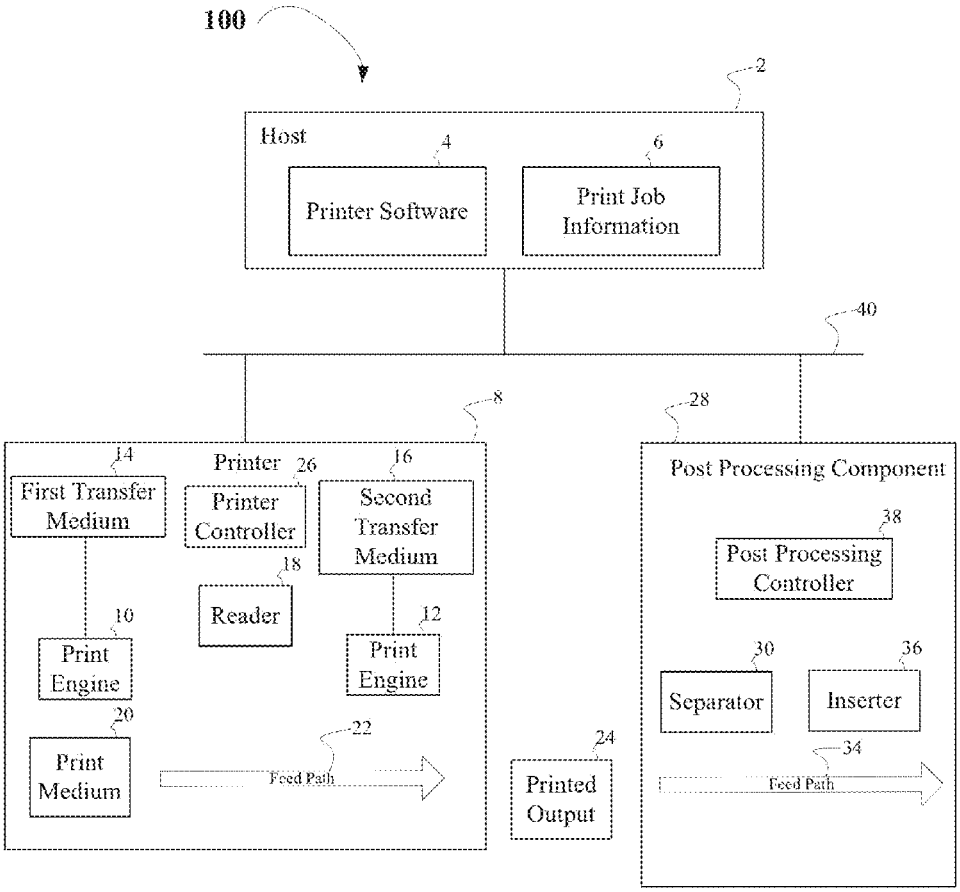
FIG. 1 illustrates one embodiment of a printing system.

FIG. 1 illustrates one embodiment of a printing system 100. Printing system 100 includes a host system 2 having printer software 4 to manage print jobs and to maintain print job information 6 on the status of print jobs managed by printer software 4. In one embodiment, printer software 4 may be implemented using either InfoPrint Manager (IPM) or InfoPrint ProcessDirector (IPPD), although other types of printing software may be used instead.

The term print job as used herein refers a print job or any component thereof, including a page of print content, a page including multiple print items or elements, such as checks, pages, an element on a page, etc. The print job may further include one or more pages, where each page has one or more elements, e.g., checks. A page may include a unit of print output, where the page may be outputted on a single piece of a print medium or multiple pages may be outputted on a roll, ribbon or web of a print medium.

Pages may be outputted on a web of a print medium in different formats, such as 2-up duplex. Each of the pages on a web or roll of paper may include multiple elements. The web may include print jobs, where each print job is one or more pages, and where each page includes one or more elements. In this way, elements and pages may be grouped in print jobs.

Host system 2 may include a processor (not shown) and memory (not shown) in which printer software 4 and print job information 6 is stored for access by the processor. The host system 2 communicates print jobs to printer 8, where each print job may have one or more pages or elements, and where each page may have one or more elements. The printer 8 includes first 10 and second 12 print engines to print output using first 14 and second 16 types of transfer media and a reader 18 capable of reading content printed using the first transfer medium 14.

Transfer media 14 and 16 includes the material or energy that is used to cause the formation of content on print medium 20. In one embodiment, transfer media 14 and 16 include wide-array inkjet print heads that employ multiple sets of nozzles that are implemented to spray droplets of ink in order to execute a print job. A print medium 20, such as a piece of paper or other material or textile, is directed through a feed path 22 by mechanical components of the printer 8, such as rollers, guides, etc. In the feed path 22, the first print engine 10 prints first content of the one or more pages of one or more print jobs on the print medium 20 using the first transfer medium 14. The first content that is printed may include an element, a page, a page of elements, etc.

A reader 18 provides print verification by reading the printed first print content to determine the quality of the output. The reader 18 may read each element on one or more pages to determine the quality of each outputted element. The reader 18 forwards the print medium 20 to the second print engine 12 to print second content using the second transfer medium 16 to produce printed output 24 including one or more print jobs of one or more pages having one or more elements printed using both transfer media 14 and 16.

The printer 8 may include a printer controller 26 to control printing operations and interface with the printer software 4 to execute the commands from the printer software 4 and provide feedback thereto. The print engines 10 and 12 may include the hardware and/or software to control the printing of content using the first 14 and second 16 types of transfer media, respectively.

The printed output 24 is forwarded to a post processing component 28 which performs various post processing operations on the printed output 24. In one embodiment, post processing includes a separator 30 that separates the paper web into separated print job output. Additional post processing may also be performed on the separated output pieces, including include stapling, collating, printing, labeling, etc.

The post processing component 28 subsequently outputs the separated output in a final form, which may include envelopes having the separated output pieces. The post processing component 28 may include a post processing controller 38 to control post processing operations and interface with the printer controller 26 and printer software 4 to execute the commands from the printer software 4 and provide feedback thereto.

An interface 40 provides intercommunication among the host 2, the printer 8, and the post processing component 20. The interface 40 may include a network, such as a Local Area Network (LAN), a Wide Area Network (WAN), a wireless network, etc. Alternatively, the interface 40 may include a bus interface, parallel interface, serial interface, or other direct line connection. In the embodiment of described herein, the host 2, printer 8, and post processing component 20 are shown as included in separate boxes. In an alternative embodiment, the printer 8 and post processing component 20 may be included in a single machine connected via one connection to the host 2. In other embodiments, all three devices 2, 8, and 20 may be included in one machine.

Figure 2A:
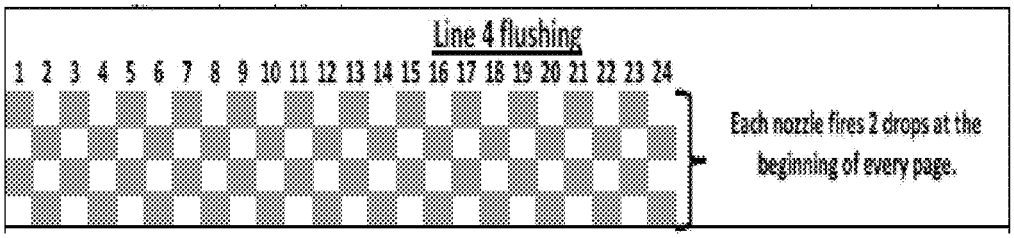
FIGS. 2A-2D illustrate embodiments of flushing schemes.
Figure 2B:
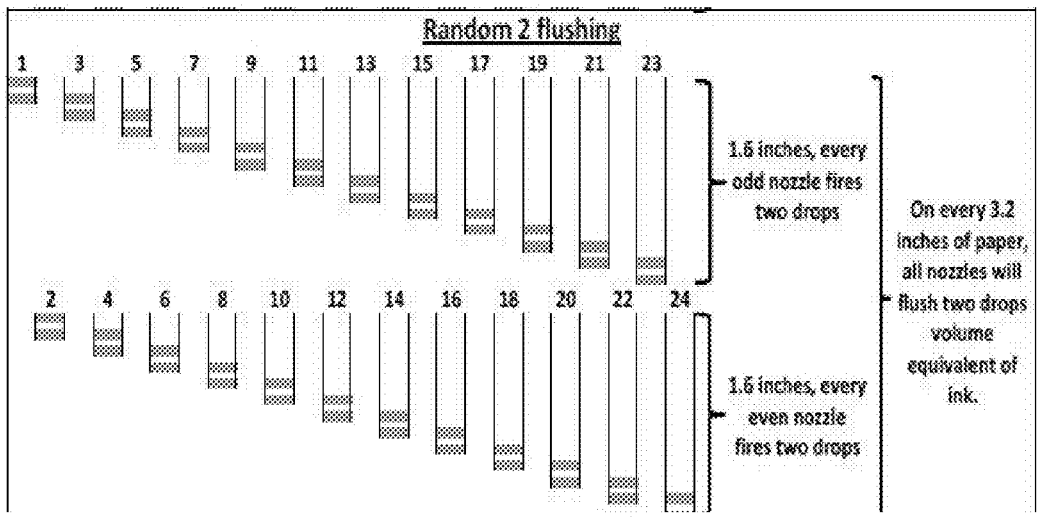
Figure 2C:
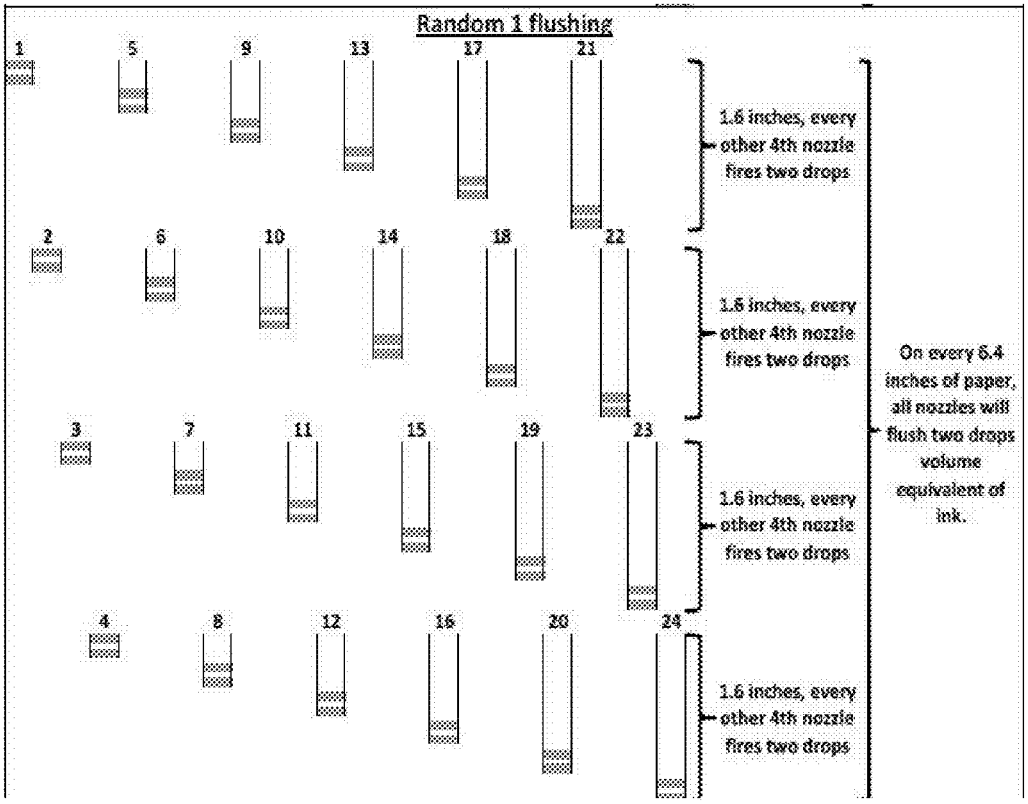
Figure 2D:
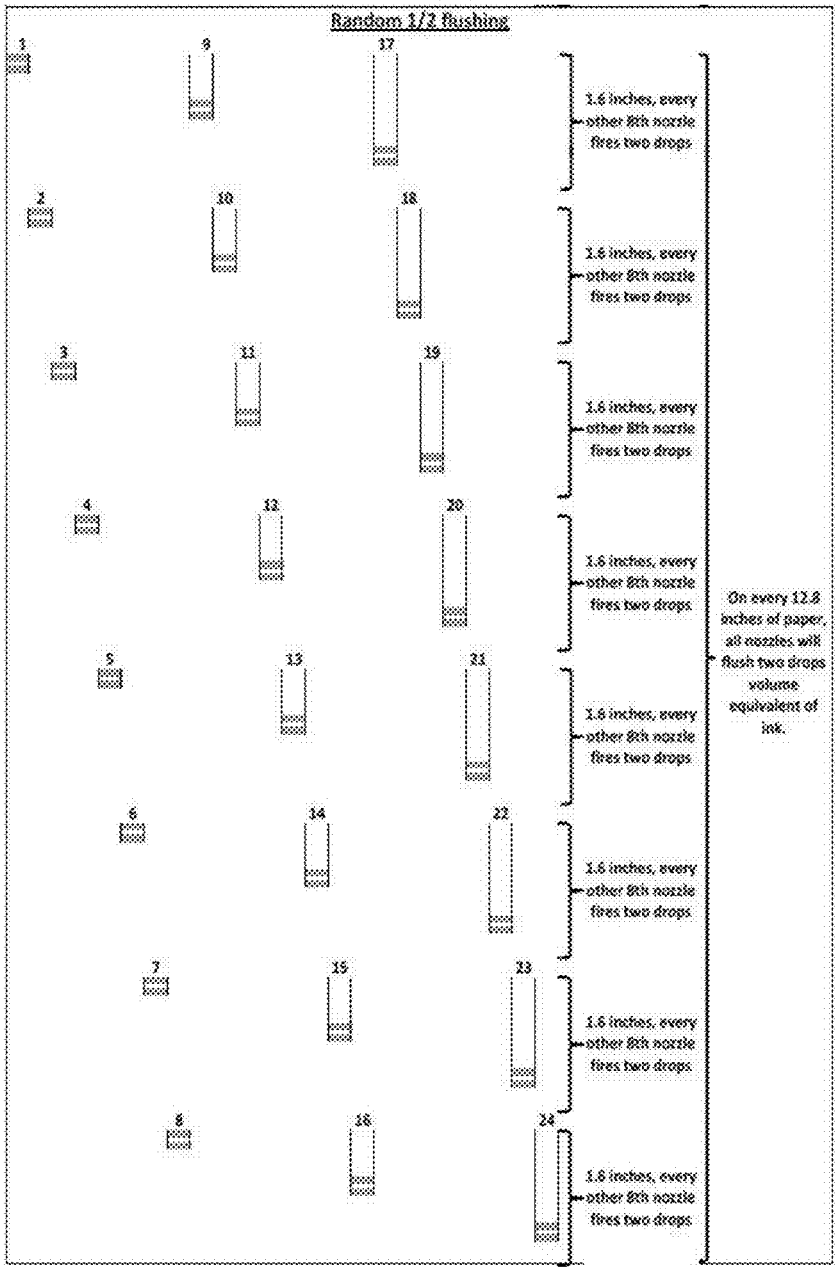

As discussed above, flushing is performed at ink jet print heads to ensure that the individual nozzles remain sufficiently wet to maintain print quality. FIGS. 2A-2D illustrate embodiments of flushing schemes for a print head having twenty four nozzles. FIG. 2A illustrates one embodiment of a line 4 flushing scheme in which each nozzle fires two drops in a straight line at the top or bottom of each medium 20 page of a print job. FIG. 2B illustrates another embodiment of a random 2 flushing scheme, where all nozzles flush two drops of ink at every 3.2 inches on a page. FIGS. 2C and 2D illustrate embodiments of random 1 and random ½ flushing schemes, respectfully. For such schemes, the nozzles are flushed less frequently than random 2 flushing (e.g., for every 6.4 inches and 12.8 inches).

As mentioned above, nozzles may continue to become clogged using the above flushing schemes because of a need to increase the frequency, or volume, of ink ejected from the nozzles during print production. According to one embodiment, printer controller 26 dynamically adjusts flushing data based on the state of print head nozzles. In such an embodiment, the state of the nozzles may be determined by examining printed output and/or nozzle response using reader 18.

In one embodiment, printer controller 26 analyzes the image of printed flushing patterns captured by reader 18 in order to detect the presence of a defective nozzle. According to one embodiment, printer controller 26 analyzes the image by measuring color values of the captured flushing pattern. For example, printer controller 26 may measure color values to identify tints and their transition locations/indices from the image. Once the printed image data is captured and the color values of the image data are measured, print irregularities associated with the flushing pattern are determined.

In one embodiment, the print irregularities are determined by estimating original optical density values for the color values in the flushing pattern and comparing those values to the measured color values to determine differences in order to detect a density and color change of the flush line pattern. A more detailed discussion of using a reader to capture printer output to determine nozzle state can be found in patent application Ser. No. 13/042,857 entitled, Jet Out Detection, herein incorporated by reference.

Figure 3:
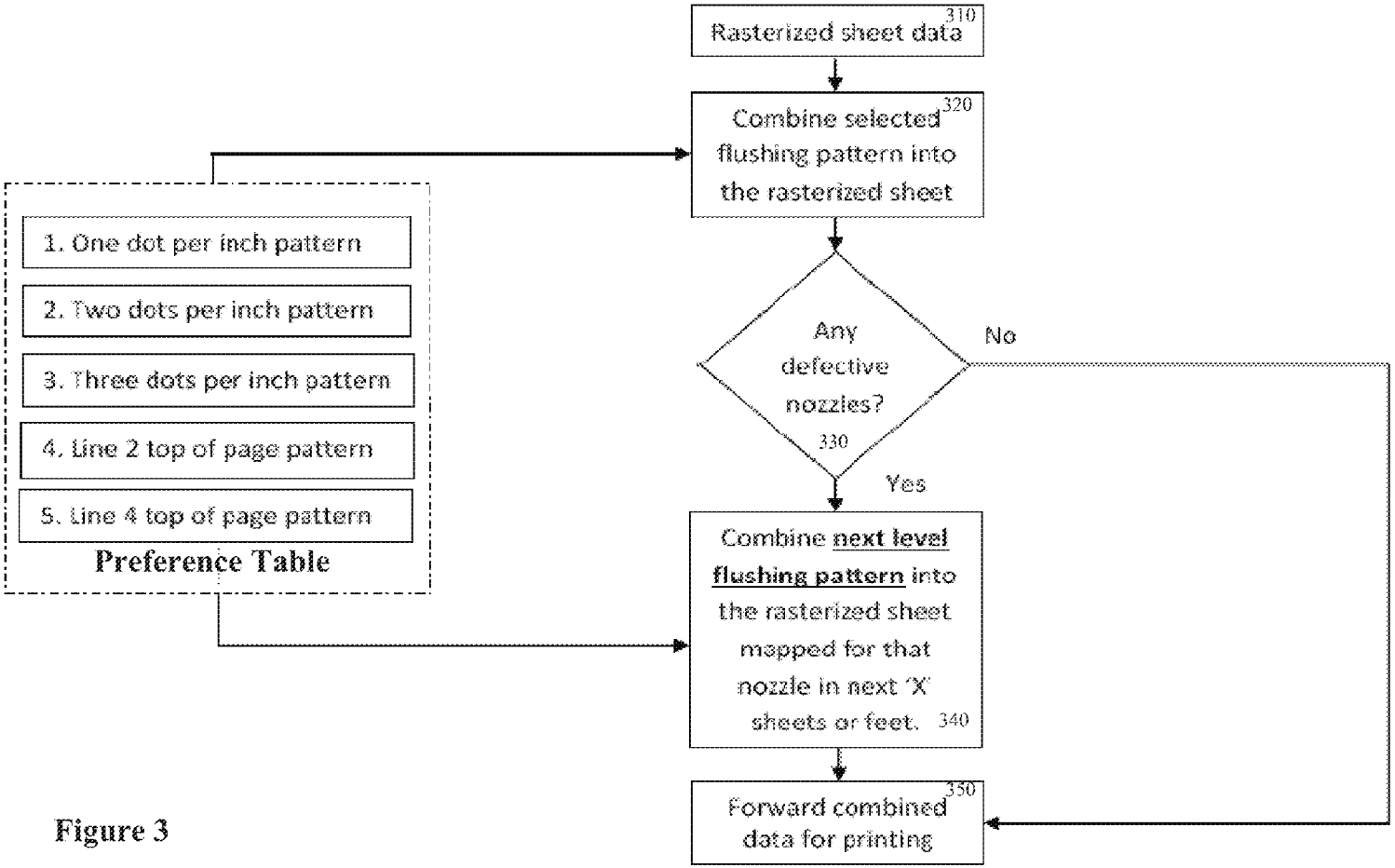
FIG. 3 is a flow diagram for one embodiment of performing dynamic nozzle flushing.

FIG. 3 is a flow diagram for one embodiment of performing dynamic nozzle flushing. At processing block 310, the sheet data is rasterized. At processing block 320, a preselected flushing pattern is combined with the sheet data. In one embodiment, the flushing pattern may include a one, two and three dots per inch patterns, as well as line 2 and line 4 patterns. At decision block 340, a determination is made as to whether a defective nozzle has been detected as a result of a previously captured flushing pattern image analysis.

If no defective nozzles have been detected, the combined flushing pattern and sheet data are forwarded for printing, processing block 350. However, if a defective nozzle has been detected, the flushing pattern is increased to a next level flushing pattern (e.g., one dot/inch to two dots/inch), and combined with the rasterized sheet for the defective nozzle, processing block 340. In one embodiment, the next level flushing pattern is user defined. For example, the next level flushing pattern may be generated using a flushing pattern preference table.

In one embodiment, the next level flushing pattern is used for a user selected number of sheets after the increase. However in other embodiments, the next level flushing pattern may used for a predetermined number of feet of the print medium. At processing block 350, the combined next level flushing pattern and sheet data are forwarded for printing.

The above-described mechanism performs dynamic flushing pattern adjustments during print production to prevent the drying of print head nozzles.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. A method comprising:

rasterizing print job data;

combining a flushing pattern with the print job data;

analyzing an image of a first flushing pattern applied on a medium during production of a print job to detect presence of one or more defective ink jet nozzles adjusting the flushing pattern from a first flushing pattern to a second flushing pattern during the production of the print job upon detecting the presence of one or more defective print head nozzles.

2. The method of claim 1 wherein the second flushing pattern has a higher flushing frequency than the first flushing pattern.

3. The method of claim 1 further comprising selecting the first flushing pattern prior to commencing production of the print job.

4. The method of claim 1 further comprising combining the first flushing pattern with the rasterized print job data prior to applying the first flushing pattern on the medium.

5. The method of claim 1 further comprising applying the second flushing pattern with the rasterized print job data on the medium.

6. The method of claim 1 further comprising transmitting the combined flushing pattern with the print job data for printing upon detecting no defective print head nozzles.

7. The method of claim 1 wherein the second flushing pattern is selected from a flushing preference table.

8. The method of claim 1 further comprising reverting from the second flushing pattern back to the first flushing pattern during production of the print job.

9. The method of claim 8 wherein reversion back to the first flushing pattern occurs after production of a predetermined number of sheets in the print job.

10. The method of claim 9 wherein reversion back to the first flushing pattern occurs upon print production on a predetermined length of the medium.

11. An article of manufacture comprising a machine-readable medium including data that, when accessed by a machine, cause the machine to perform operations comprising:

rasterizing print job data;

combining a flushing pattern with the print job data;

analyzing an image of a first flushing pattern applied on a medium during production of a print job to detect presence of one or more defective ink jet nozzles adjusting the flushing pattern from a first flushing pattern to a second flushing pattern during the production of the print job upon detecting the presence of one or more defective print head nozzles.

12. The article of manufacture of claim 11 wherein the second flushing pattern is selected from a flushing preference table.

13. The article of manufacture of claim 11 comprising a machine-readable medium including data that, when accessed by a machine, further causes the machine to perform operations comprising combining the second flushing pattern with the rasterized print job data prior to applying the second flushing pattern on the medium.

14. The article of manufacture of claim 11 comprising a machine-readable medium including data that, when accessed by a machine, further causes the machine to perform operations comprising reverting from the second flushing pattern back to the first flushing pattern during production of the print job.

15. The article of manufacture of claim 14 wherein reversion back to the first flushing pattern occurs after production of a predetermined number of sheets in the print job.

16. The article of manufacture of claim 15 wherein reversion back to the first flushing pattern occurs upon print production on a predetermined length of the medium.

17. The article of manufacture of claim 11 comprising a machine-readable medium including data that, when accessed by a machine, further causes the machine to perform operations comprising selecting the first flushing pattern prior to commencing production of the print job.

18. The article of manufacture of claim 17 comprising a machine-readable medium including data that, when accessed by a machine, further causes the machine to perform operations comprising combining the first flushing pattern with rasterized print job data prior to applying the first flushing pattern on the medium.

19. The article of manufacture of claim 11 comprising a machine-readable medium including data that, when accessed by a machine, further causes the machine to perform operations transmitting the combined flushing pattern with the print job data for printing upon detecting no defective print head nozzles.

20. The article of manufacture of claim 11 wherein the second flushing pattern has a higher flushing frequency than the first flushing pattern.

* * * * *